US009111698B2

(12) United States Patent
Crevenat

(10) Patent No.: US 9,111,698 B2
(45) Date of Patent: Aug. 18, 2015

(54) METHOD FOR CUTTING OFF AN ELECTRIC ARC, METHOD AND DEVICE FOR PROTECTING AN INSTALLATION AGAINST VOLTAGE SURGES

(71) Applicant: ABB France, Courtaboeuf (FR)

(72) Inventor: Vincent Crevenat, Izaux (FR)

(73) Assignee: ABB FRANCE, Courtaboeuf (FR)

( * ) Notice: Subject to any disclaimer, the term of this patent is extended or adjusted under 35 U.S.C. 154(b) by 270 days.

(21) Appl. No.: 13/656,021

(22) Filed: Oct. 19, 2012

(65) Prior Publication Data

US 2013/0100558 A1 Apr. 25, 2013

(30) Foreign Application Priority Data

Oct. 21, 2011 (FR) ..... 11 59557

(51) Int. Cl.
*H01T 1/02* (2006.01)
*H01H 9/36* (2006.01)
*H01T 4/14* (2006.01)

(52) U.S. Cl.
CPC .. *H01H 9/36* (2013.01); *H01T 1/02* (2013.01); *H01T 4/14* (2013.01)

(58) Field of Classification Search
CPC combination set(s) only.
See application file for complete search history.

(56) References Cited

U.S. PATENT DOCUMENTS 2,890,383 A 6/1959 Olsen
3,287,588 A * 11/1966 Lee et al. ..... 313/154
3,631,319 A * 12/1971 Matthews ..... 315/241 R
3,944,887 A * 3/1976 Suzuki ..... 361/56
5,440,441 A * 8/1995 Ahuja ..... 361/62
7,295,416 B2 * 11/2007 Halvarsson et al. ..... 361/120
2007/0285858 A1 12/2007 Breuer et al.
2008/0106840 A1 * 5/2008 Frescaline ..... 361/230
2009/0213504 A1 * 8/2009 Hallstrom et al. ..... 361/16
2013/0063155 A1 * 3/2013 Tarui ..... 324/601

FOREIGN PATENT DOCUMENTS

DE 102 45 144 B3 1/2004
DE 10 2004 002 581 A1 8/2005
EP 0 793 318 A1 9/1997

OTHER PUBLICATIONS

Preliminary Search Report with a Written Opinion issued by the French Patent Office on Sep. 11, 2012, in the corresponding French Patent Application No. 1159557. (6 pages).

* cited by examiner

*Primary Examiner* — Thienvu Tran
*Assistant Examiner* — Angela Brooks
(74) *Attorney, Agent, or Firm* — Buchanan Ingersoll & Rooney PC

(57) ABSTRACT

The method comprising displacing the formed electric arc towards an electrode located in an intermediate position between both main electrodes; a separating the formed electric arc into two secondary electric arcs, a semiconductor switch, normally open, connecting the intermediate electrode to one of the main electrodes; closing the semiconductor switch in order to extinguish the secondary electric arc between both electrodes connected by the semiconductor switch; opening the semiconductor switch in order to extinguish the other secondary electric arc. The disclosure further relates to a protection method and a protection device, notably a protection device specially designed for applying the method.

15 Claims, 3 Drawing Sheets

Fig.4
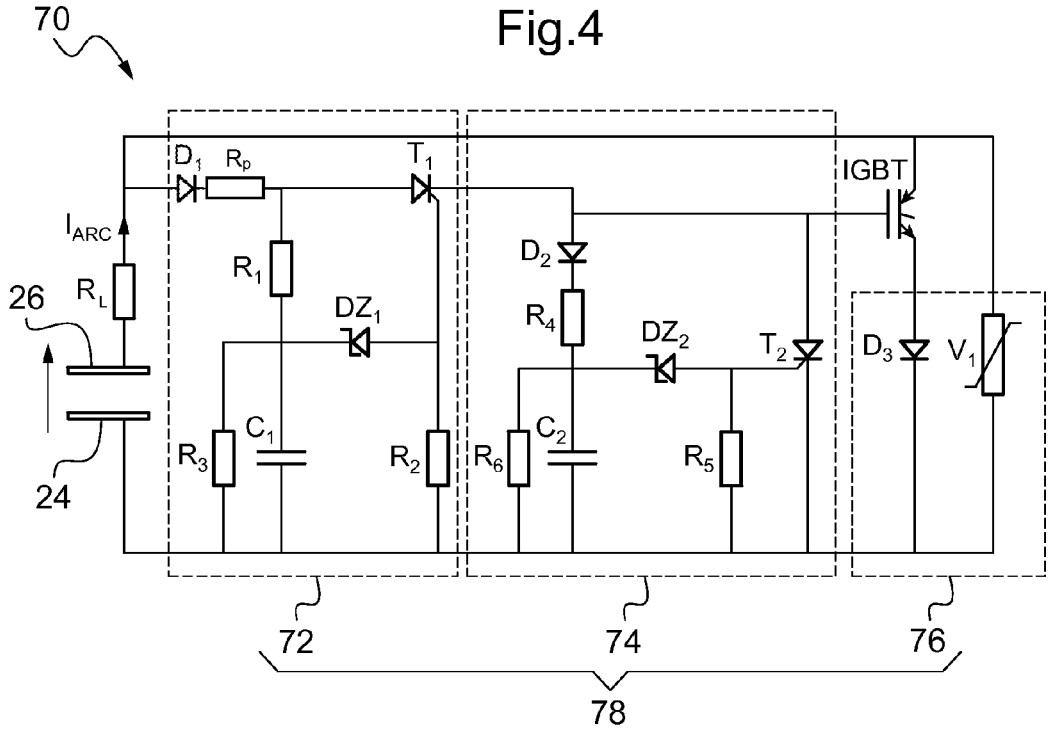
Fig.5
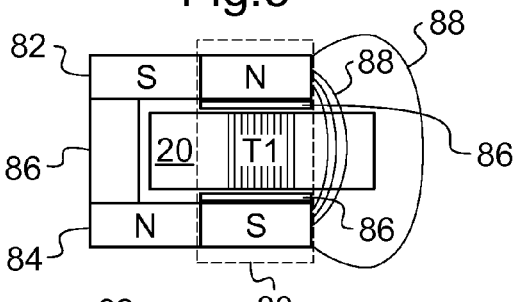
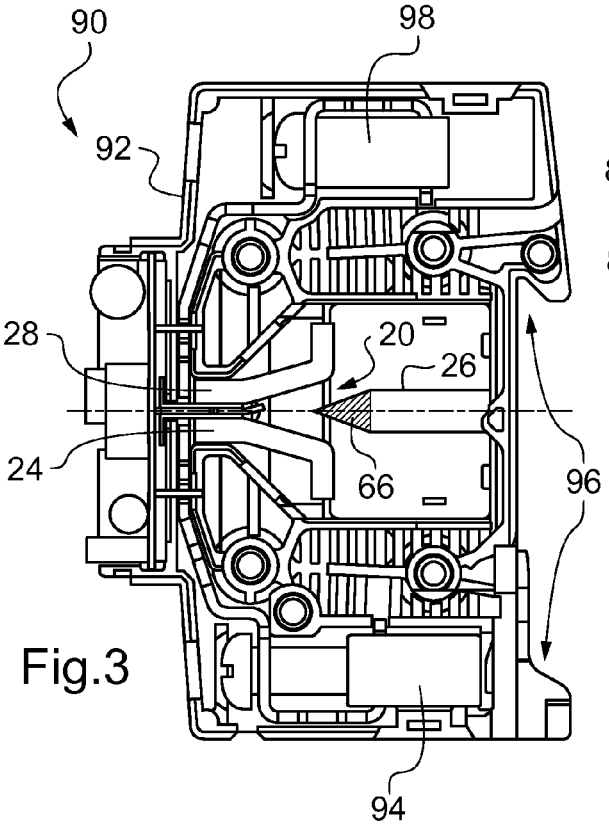
Fig.3
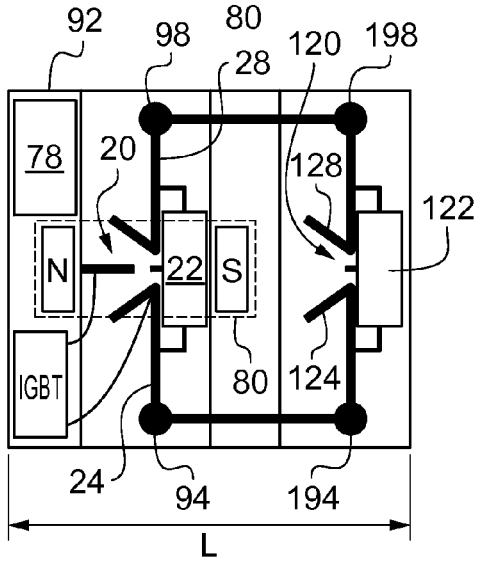
Fig.8

Fig.6
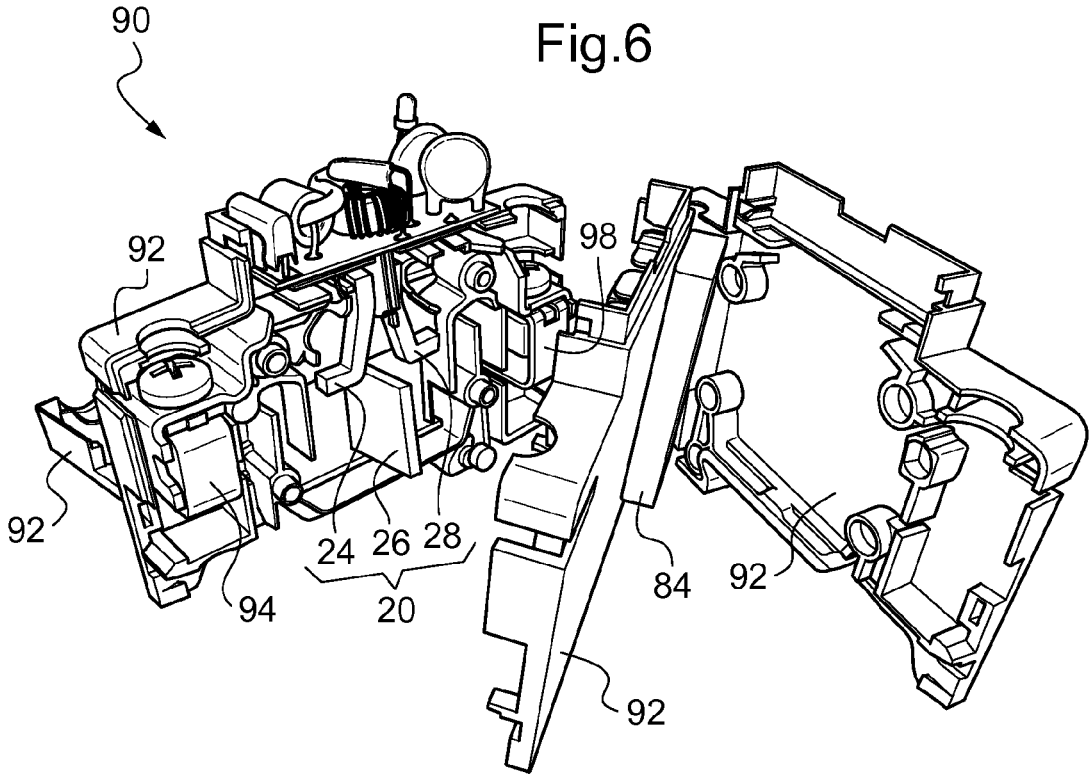
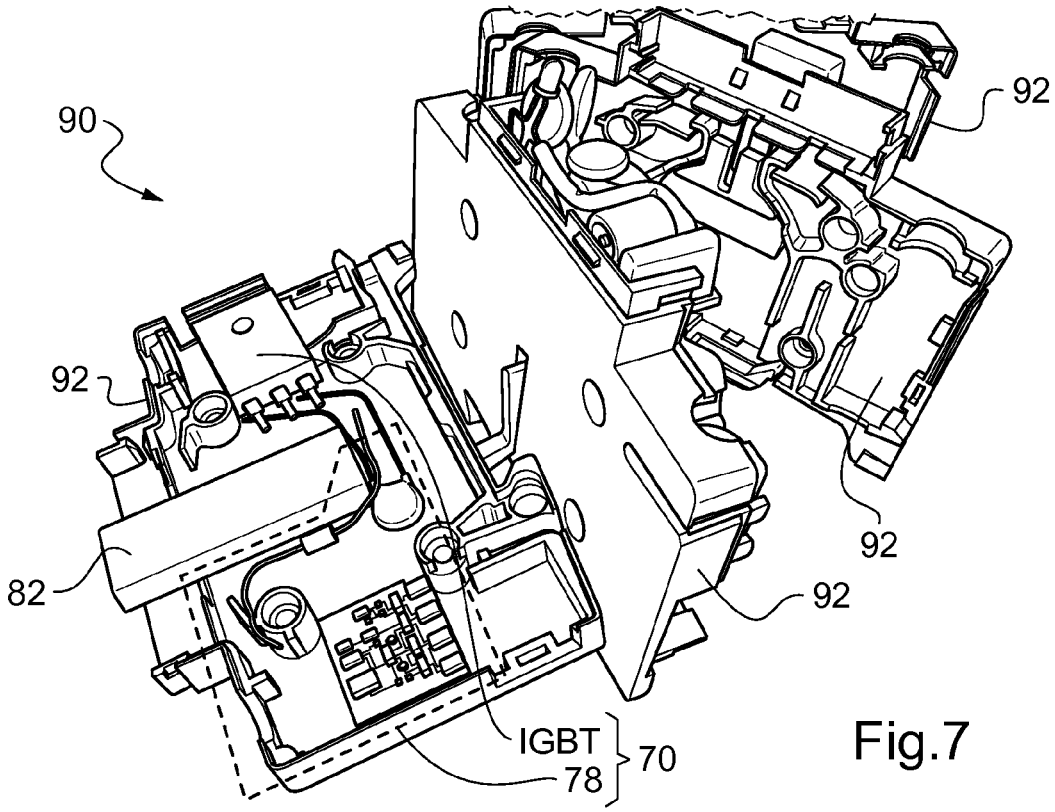
Fig.7

METHOD FOR CUTTING OFF AN ELECTRIC ARC, METHOD AND DEVICE FOR PROTECTING AN INSTALLATION AGAINST VOLTAGE SURGES

RELATED APPLICATION(S)

This application claims priority under 35 U.S.C. §119 to French application 11/59557 filed in France on Oct. 21, 2011, the entire content of which is hereby incorporated by reference in its entirety.

FIELD

The disclosure relates to protecting electrical equipment or installations such as protecting electrical equipment against voltage surges, due to lightning impact, for example.

BACKGROUND INFORMATION

It is known how to ensure protection of an electric installation against voltage surges by means of devices including at least one component for protection against voltage surges, in particular one or several varistors and/or one or several spark-gaps. Such devices are currently designated by the term of lightning arrester. For single-phase installations, a varistor can be connected between the phase and the neutral while a spark-gap is connected between the neutral and the ground. For three-phase installations, varistors can be between the different phases and/or between each phase and the neutral and a spark-gap between the neutral and the ground. For electric installations operating with a DC current, for example for installations of photovoltaic generators, resort is also made to varistors and optionally spark-gaps.

The use of a spark-gap as a protective device against voltage surges may pose a problem for dealing with the follow current of the spark-gap. Indeed, because of priming of the spark-gap, a current may continue to flow through the primed spark-gap and this even after the end of the transient voltage surge. This current is sustained by the voltage source of the electric installation to be protected. This current then corresponds to a follow current which is desirably cut off by breaking the arc formed in the spark-gap. This problem of cutting off the follow current is notably posed in the case of an electric installation operating under a DC current such as an installation for photovoltaic generation of electricity.

Exemplary embodiments of the present disclosure are related to lightning arresters for which different breaker systems can be used.

For example, in the case when an arc only forms between two electrodes at the end of the life of the varistors, there exist single-use breaker systems including mechanical short-circuiting of the arc and then dealing with the short-circuit current with a fuse.

In another example, a spark-gap can be used as a lightning arrester, arcs are repeatedly formed between the electrodes of the spark-gap, preventing the use of single-use breaker systems which are unsuitable. The cutting-off of arcs which repeatedly form, moreover corresponds to a need for other pieces of equipment for which the purpose is to cut off a current as a result of a fault, or any external action. Multiple-use breaker systems can be used both for pieces of equipment such as contactors, circuit breakers or switches and for lightning arresters with spark-gaps.

The systems disclosed herein are based on enlarging the distance between the electrodes between which the arc forms or on separating the arc into a multiplicity of arcs. In both cases, the cutting-off of the arc is achieved by raising the so-called arc voltage to a sufficiently high value so that the voltage source is no longer capable of maintaining this arc voltage. Thus, when the voltage of the source is high, the multiple-use breaker systems should allow an all the greater enlargement of the distance between the electrodes or an all the greater separation into a multiplicity of arcs. For high operating voltages which may be encountered in photovoltaic installations, for example between 500 and 1,000V or even up to 1,500V because of the DC nature of the current, adaptation of the previous systems to the cutting-off of such voltage levels may lead to significant dimensional constraints. Now lightning arrester devices can be contained in casings said to be "mountable" on a DIN rail. These casings do not exceed a width of 17.5 mm and a length of 92 mm, and are then too small for being able to meet such dimensional constraints.

Therefore there exists a need for a method for cutting off an electric arc with which the bulkiness of the devices applying it, may be less significant.

Exemplary embodiments of the present disclosure are directed to a method for cutting off an electric arc which forms between two main electrodes, the method including displacing the electric arc formed towards an electrode located in an intermediate position between both main electrodes, separating the electric arc formed into two secondary electric arcs between the main electrodes and the intermediate electrode, a semiconductor switch normally open, connecting the intermediate electrode to one of the main electrodes, closing the semiconductor switch for extinguishing the secondary electric arc between both electrodes which are connected by the semiconductor switch, opening the semiconductor switch in order to extinguish the other secondary electric arc.

In an exemplary embodiment disclosed herein, the method includes a time-out after separation of the arc formed into two second electric arcs in order to prevent an arc from being re-formed between both main electrodes upon closing the semiconductor switch.

In another exemplary embodiment, the method includes a time-out after closing the semiconductor switch in order to prevent the extinguished arc from being re-formed between the intermediate electrode and one of the main electrodes upon opening the semiconductor switch.

In another exemplary embodiment, a method for protecting an electric installation against transient voltage surges is disclosed, the method applying the cutting-off of an electric arc according to the previous cut-off method when a transient voltage surge occurs in the electric installation to be protected causing the formation of a first electric arc between both main electrodes, the main electrodes being connected to the electric installation to be protected.

According to the present disclosure, an exemplary electric installation is connected to a low voltage electricity distribution network.

According to another exemplary embodiment, an electric installation operates under a DC current, such as an installation for photovoltaic generation of electricity.

An exemplary embodiment of the present disclosure is directed to a protection device for protecting an electric installation against transient voltage surges, including two terminals for connecting the device to the electric installation to be protected, a first main electrode and a second main electrode, each main electrode being connected to respectively one of the connection terminals, an electrode located in an intermediate position between the first main electrode and the second main electrode, a semiconductor switch, normally open, connecting the intermediate electrode to the first main electrode, a circuit for controlling the semiconductor switch, the control circuit being provided in order to successively ensure closing of the switch, and then opening of the switch, after an electric arc formed between the main electrodes has been divided into two arcs via the intermediate electrode.

According to an exemplary embodiment, the semiconductor switch is an insulated gate bipolar transistor or a field effect transistor with a metal-oxide gate.

According to another exemplary embodiment, the control circuit ensures a time-out between the division of the electric arc into two arcs via the intermediate electrode and the closing of the switch and/or between the closing of the switch and the opening of the switch.

According to another exemplary embodiment, the electrodes are fixed, both main electrodes being positioned facing each other from a first side to a second side and forming a spark-gap; and the intermediate electrode partly extending between both main electrodes from the second side.

According to an exemplary embodiment, the device includes a unit for triggering an arc between the main electrodes if a transient voltage surge occurs on the electric installation to be protected, the triggering unit including an electrode for triggering an arc from the first side of the main electrodes.

According to an exemplary embodiment, the intermediate electrode has a wedge-shaped end portion on the side where the intermediate electrode extends between both main electrodes.

According to the present disclosure, the exemplary protection device includes a magnet positioned in order to displace, in the direction from the first side to the second side, an electric arc which forms between the main electrodes of the spark-gap and/or the main electrodes being divergent from the first side to the second side.

According to an exemplary embodiment, the device includes an additional connection terminal and an additional spark-gap formed by two additional electrodes, one of the additional electrodes being connected to the additional terminal and the other one of the additional electrodes being connected to one of the two terminals for connecting the device to the electric installation.

According to an alternative, the device is specially designed for applying the previous method.

SUMMARY

An exemplary method for cutting off an electric arc being formed between two main electrodes is disclosed, the method comprising: displacing the formed electric arc towards an electrode located in an intermediate position between both main electrodes; separating the electric arc formed into two secondary electric arcs between the main electrodes and the intermediate electrode, a semiconductor switch, normally open, connecting the intermediate electrode to one of the main electrodes; closing the semiconductor switch for extinguishing the secondary electric arc between both electrodes which are connected by the semiconductor switch; and opening the semiconductor switch in order to extinguish the other secondary electric arc.

An exemplary device for protecting an electric installation against transient voltage surges is disclosed, comprising: two terminals for connecting the device to the electric installation to be protected; a first main electrode and a second main electrode, each main electrode being connected to respectively one of the connection terminals; an electrode located in an intermediate position between the first main electrode and the second main electrode; a semiconductor switch, normally open, connecting the intermediate electrode to the first main electrode; a circuit for controlling the semiconductor switch, the control circuit being provided in order to successively ensure closing of the switch, and then opening of the switch, after division of an electric arc formed between the main electrodes into two arcs by the intermediate electrode.

BRIEF DESCRIPTION OF THE DRAWINGS

Other features and advantages of the disclosure will become apparent upon reading the detailed description which follows, of embodiments of the disclosure, given only as an example and with reference to the drawings wherein:

FIG. 3 shows a sectional view of in accordance with an exemplary embodiment a device for protection against voltage surges;

FIG. 4 shows an electric diagram of the circuit for controlling a semiconductor switch of the protection device of FIG. 3 in accordance with an exemplary embodiment;

FIG. 5 shows a schematic illustration of a detection device having a magnet in accordance with an exemplary embodiment;

FIGS. 6 and 7 show exploded views of a detection device in a cartridge which is "mountable" on a DIN rail in accordance with an exemplary embodiment;

FIG. 8 shows a schematic illustration of a protection device with an additional connection terminal in accordance with an exemplary embodiment.

DETAILED DESCRIPTION

Exemplary embodiments of the present disclosure relates to a method for cutting off an electric arc. The method is applied for a first main electrode and a second main electrode between which an electric arc to be broken, may form as a result of a fault, of an external action or of an external event, such as lightning impact or the separation of mobile contact in a mechanical switch.

A semiconductor switch connects the intermediate electrode to the first main electrode. A semiconductor switch is a switch formed by superposition of layers of doped semiconductors. Thus, a semiconductor switch corresponds to a switch for which the closed or open nature is allowed by a semiconductor operating in a switching mode, either letting through the current or interrupting it. Unlike a mechanical switch, the semiconductor switch is without any mobile contact or mobile mechanical part, the movement of which achieves the switching between the closed condition and the open condition and ensures interruption of the current by the distance separating the mobile contact and the fixed contact. The semiconductor switch then ensures interruption of the current without causing a creation of an arc unlike a mechanical switch. The semiconductor switch may be a bipolar transistor with a gate (better known as a "Insulated Gate Bipolar Transistor" abbreviated as "IGBT") or a field effect transistor with a metal oxide gate (better known as a "Metal Oxide Semiconductor Field Effect Transistor" abbreviated as "MOSFET" or "MOS").

Figure 1:
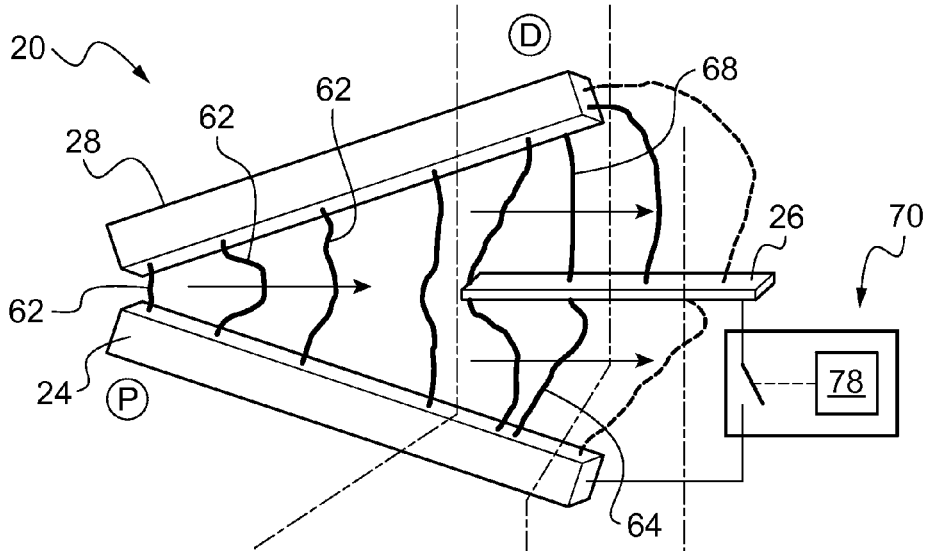
FIG. 1 shows a schematic illustration of the different phases of a cut-off method applied on a spark-gap in accordance with an exemplary embodiment.

FIG. 1 shows a schematic illustration of the different phases of a cut-off method applied on a spark-gap in accordance with an exemplary embodiment. According to FIG. 1, the method is applied on a spark-gap 20 notably formed with the main electrodes described earlier and also including the intermediate electrode and the semiconductor switch as already discussed. According to FIG. 1, the main electrodes 24 and 28 are positioned facing each other from a first side (referenced by an encircled P) to a second side (referenced by an encircled D), the intermediate electrode 26 partly extending between both main electrodes from the second side D.

The exemplary cut-off method as disclosed herein is applied after forming a first electric arc 62 between both main electrodes 24 and 28. The first electric arc 62 between both main electrodes 24 and 28 is also designated by the term of "electric arc formed" 62. As a result of the formation of the first electric arc 62, the method includes the displacement of the electric arc 62. According to FIG. 1, the arc 62 is displaced from the first side P to the second side of the spark-gap D. According to the exemplary embodiment illustrated in FIG. 1, the displacement of the arc is facilitated by the fact that the main electrodes 24 and 28 diverge from the first side P to the second side D. In another exemplary embodiment, a magnet may be provided along with the divergence of the electrodes 24 and 28 to facilitate displacement of the arc.

When the electric arc 62 is displaced as far as the level of the intermediate electrode 26, the exemplary method includes separation of the first electric arc 62 into two second electric arcs 64 and 68. Each of the two second electric arcs 64 and 68 is also designated by the term of "secondary electric" arc 64 or 68. The intermediate electrode 26 can have a floating potential. The second electric arc 64 is formed between the first main electrode 24 and the intermediate electrode 26 while the second electric arc 68 is formed between the second main electrode 28 and the intermediate electrode. The steps of the method before separation of the arc 62 into arcs 64 and 68 corresponds to the phase referenced as 32. As shown in FIG. 1, the arc 62 is illustrated several times in positions successively assumed during its displacement.

After the separation of the arc 62 into arcs 64 and 68, the second arcs may also be displaced in the direction from the first side P to the second side D (from left to right according to FIG. 1). The steps for separation into two arcs 64 and 68 and for displacement of both arcs 64 and 68 correspond to the phase referenced as 34. According to FIG. 1, the arcs 64 and 68 are illustrated several times in positions successively assumed during their displacement.

The exemplary method then includes the closing of the semiconductor switch in order to extinguish the second electric arc 64 between the intermediate electrode 26 and the first electrode 24. Closing of the switch actually causes a short-circuit of the arc 64 by setting the first main electrode 24 and the intermediate electrode 26 to the same potential. Because of the short-circuit, the current flowing in the arc 64 entirely flows into the switch which causes extinction of the arc 64. This step of the method corresponds to the phase referenced as 36.

After extinction of the arc 64, the method includes the opening of the semiconductor switch in order to extinguish the other second arc 68. Indeed, opening the switch causes insulation of the intermediate electrode 26 relatively to the first main electrode 24. As these electrodes 24 and 26 are no longer connected either by the switch or by the arc 64 extinguished beforehand, the follow current drained by the arc 68 can no longer flow as far as the main electrode 24 except if it recreates an electric arc. For this, the voltage between the intermediate electrode 26 and the main electrode 24 should be greater than the breakdown voltage of the air gap which separates these electrodes 24 and 26. It is helpful to note that the breakdown voltage of an air gap is greater than the voltage for maintaining an already formed arc and crossing this same gap. If the voltage of the source can be sufficient for maintaining an arc initially formed between 24 and 26, the source voltage is insufficient for allowing breakdown of this same air gap, e.g., insufficient for allowing formation of a new arc between 24 and 26. The distance between the electrodes 24 and 26 is selected accordingly. Thus, the opening of the switch causes extinction of the arc 68. This step of the method corresponds to the phase referenced as 38.

After application of the exemplary method, the follow current is completely cut off because of the extinction of both arcs 64 and 68. The cutting-off of an arc provided by the exemplary method is achieved without increasing the voltage for maintaining the arc in the spark-gap, unlike the spark-gap of the prior art. Thus according to this method, it is no longer necessary to cause the arc-maintaining voltage to exceed the voltage of the source by fractionating many times the arc or by increasing the size of the arc. In an exemplary embodiment, the method disclosed herein may therefore be applied in a spark-gap having insulation distances between these different electrodes which are sufficient for preventing the formation of a new arc with the voltage of the source of the installation. As the voltage for forming a new arc is much higher than the voltage for maintaining an already formed arc, the exemplary method of the present disclosure allows reduction in the distances between the electrodes of the spark-gap. The spark-gap applying the method may have limited bulkiness while ensuring cutting-off of the electric arc maintained by high voltage sources.

The positioning of the electrodes according to FIG. 1 corresponds to fixed electrodes in relative proximity to each other, the main electrodes forming a spark-gap. Alternatively it may be provided that in non-illustrated embodiments, the position of one or both electrodes can be adjusted relative to each other. For example, one of the main electrodes 24 and 28 may be a mobile contact of a mechanical switch while the other one of the main electrodes 24 and 28 is a fixed contact, the intermediate electrode 26 may also be mobile relative to the main electrodes 24 and 28, with a movement either correlated or uncorrelated with the movement of the main electrodes.

In exemplary embodiments having mobile electrodes, the exemplary method of the present disclosure also allows reduction in the maximum separation distances of the electrodes between them. The exemplary protection device with mobile electrodes applying the disclosed method may itself also have limited bulkiness while ensuring the cutting-off of the electric arc maintained by high voltage sources.

The exemplary cutting-off method already discussed may be particularly advantageous when it is applied in a more general method for protecting an electric installation against transient voltage surges.

In the field of protection against transient voltage surges, for example due to lightning impact, provision may be made for positioning a spark-gap at the terminals of an electric installation, as a lightning arrester. The formation of an electric arc in the spark-gap during the transient voltage surge gives the possibility of limiting the voltage at the terminals of the electric installation to be protected. However, at the end of the transient voltage surge event, this electric arc can be maintained by the voltage source of the electric installations to be protected. This maintaining of the arc perturbs return to normal operation of the installation. The application of the previous cutting-off method in a method for protection against voltage surges then gives the possibility of cutting off the current immediately even for high source voltages while limiting the bulkiness of the protection device applying the protection method.

Exemplary embodiments of the present disclosure allows protection of electric installations, such as electric installations connected to a low voltage electric distribution network.

According to a known technique, an electric installation connected to a low voltage electricity distribution network can include a low voltage electric installation with an assigned effective voltage up to 1,000V AC or up to 1,500V DC except for pieces of electric equipment of very low voltage. Very low voltage pieces of electric equipment may be defined as pieces of equipment having an effective assigned voltage of less than 12V AC or DC. Thus the electric installation to be protected may be an electric installation operating with a voltage in a range between 12V and 1,000V AC and between 12V and 1,500V DC. Such very low voltage pieces of electric equipment are exemplary directly connected to a low voltage electricity network. In other words, the method for protecting an electric installation connected to a low voltage electricity network as described herein is distinguished from a known method for protecting microelectronic components against voltage surges.

Among the electric installations connected to a low voltage electricity distribution network, the exemplary protection method is applied to electric installations operating with DC current, for example for an installation for photovoltaic generation of electricity. The application of the cutting-off method in a method for protecting an installation against voltage surges notably gives the possibility of cutting off follow currents maintained by a DC voltage source of 1,500V such as in installations for photovoltaic generation of electricity.

Figure 2:
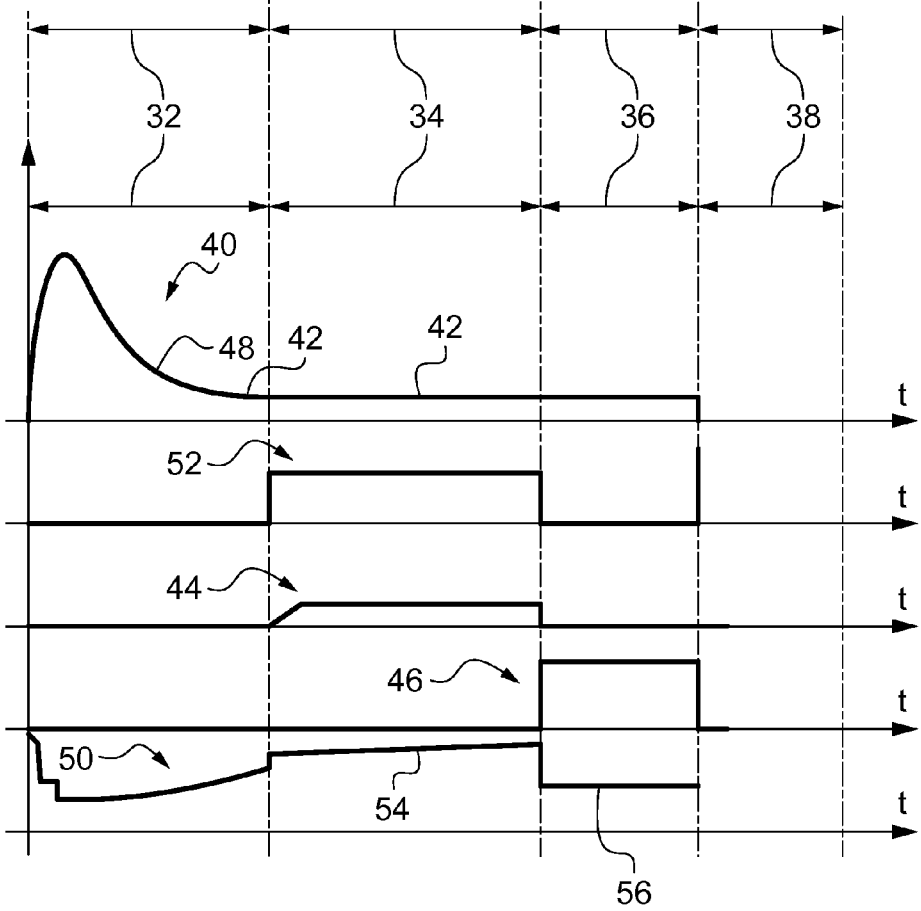
FIG. 2 shows a time graph of the change in the various electric quantities during the application of the method schematized in FIG. 1 in accordance with an exemplary embodiment.

FIG. 2 shows a time graph of the change in the various electric quantities during the application of the method schematized in FIG. 1 in accordance with an exemplary embodiment. In particular, FIG. 2 shows a time graph of the change in the various electric quantities during the application of the previous cutting-off method with the purpose of protection against voltage surges of an electric installation operating with a DC current.

The origin of the times shown in FIG. 2 corresponds to the beginning of a transient voltage surge such as a lightning impact. According to FIG. 2, the axis of times may then be cut out into the phases 32, 34, 36 and 38 described earlier.

During phase 32, an arc is formed because of the voltage surge at the terminals of the main electrodes 24 and 28 of the spark-gap 20. The voltage at the terminals of the main electrodes is illustrated by the curve 50. During such a voltage surge, the spark-gap limits the voltage 50 to the voltage for priming the arc in the spark-gap. This arc allows a current 40 to flow between the main electrodes 24 and 28. At the beginning of phase 32, this current 40 then corresponds to a lightning current 48 which is the major portion of the current associated with the transient voltage surge. This lightning current 48 is positive or negative depending on the polarity of the transient voltage surge, lightning may for example be with a positive or negative discharge. After the transient voltage surge, the current 40 and the voltage 50 drop. The formed electric arc 62 may be maintained and may drain the follow current provided by the voltage source of the electric installation to be protected. The current 40 then corresponds to the follow current 42 and the voltage 50 corresponds to the voltage for maintaining the arc 62 between the main electrodes 24 and 28.

During the transient voltage surge and then during the flow of the follow current, the arc 62 is displaced towards the intermediate electrode 26. In an exemplary embodiment, the electrodes 24 and 28 can be divergent on the side D of the intermediate electrode 26, the displacement of the arc towards the intermediate electrode 26 causes an increase in the voltage of the arc after the transient voltage surge. Indeed, the voltage of the arc depends on the length of the arc on the one hand and on its number of feet, here two, on the other hand: one at the electrode 24 and the other one at the electrode 28. This increase in the voltage 50 continues with the displacement of the arc 62 until the arc 62 is separated into two arcs 64 and 68 by the intermediate electrode 26.

Phase 34 is then entered. Upon separation of the arc 62 into two arcs 64 and 68, the voltage 50 at the terminals of the main electrodes 24 and 28 suddenly increase because of the increase in the number of arc feet which passes from 2 to 4: i.e. two feet for each of the arcs 64 and 68. The separation of the arc 62 into two arcs 64 and 68 also corresponds to the occurrence of a voltage 52 between the intermediate electrode 26 and the electrode 24. When the device is symmetrical along the plane of the intermediate electrode 26, the voltage 52 corresponds to half the voltage 54 between the electrodes 24 and 28. This voltage 52 is maintained until closure of the semiconducting switch. However the voltage 52 may slightly increase with the voltage 54 because the arcs 64 and 68 continue to be displaced between electrodes diverging towards the side D.

Upon closing the semiconductor switch, phase 36 is entered. Closing of the semiconductor switch causes formation of a short-circuit between the electrode 26 and the electrode 24. The current 46 flowing through the switch corresponds to the currents having been drained previously by the short-circuited arc 64, i.e. the current 46 corresponds to the follow current 42. The voltage 52 between the intermediate electrode 26 and the electrode 24 is cancelled out and the arc 64 is broken. The voltage 50 between the electrode 24 and 28 is then decreased and passes from voltage 54 to voltage 56.

In an exemplary a time-out between the separation of the first arc 62 and the closure of the semiconductor switch can be provided. Such a time-out corresponds to the duration of the phase 34. With this time-out it is possible to make sure that upon closing the switch, the current drained by the spark-gap actually corresponds to a follow current 42 and no longer to a lightning current 48. Thus the possibility of the lightning current 48 of flowing through the semiconductor switch which would damage the semiconductors of the switch, is avoided. Moreover, independently of the use of the cutting-off method with a purpose of protection against voltage surges, timing out the duration of the phase 34 contributes to preventing an arc from being reformed between both main electrodes 24 and 28 upon closing the semiconductor switch. Indeed, the duration of this time-out may be selected so as to make sure that before the closing of the switch, the air initially ionized by the first arc 62 is deionized.

Subsequently to the closing of the semiconductor switch, phase 38 is entered, by opening this same switch. The current 46 flowing through the switch is then zero and the follow current 42 can no longer flow between the intermediate electrode 26 and the main electrode 24. This causes extinction of the arc 68, the voltage between the main electrodes then becomes equal to the voltage of the electric installation source and the current 40 flowing through the spark-gap is zero. The follow current 42 is therefore cut off. A time-out may be provided between the closing and opening of the semiconductor switch in order to prevent the arc from reforming between the intermediate electrode 26 and the first main electrode 24 upon opening the semiconductor switch. The duration of this time-out may be selected so as to make sure that, before opening the switch, the air initially ionized by the arc 64 is deionized. Such a time-out corresponds to the duration of the phase 36.

An exemplary embodiment of the present disclosure relates to a device for protecting an installation against transient voltage surges. The exemplary protection device includes two terminals for connecting the device to the electric installation to be protected. With reference to FIG. 1, the device further includes the first main electrode 24 and the second main electrode 28. The main electrodes may form the spark-gap 20 between each other. These two main electrodes 24 and 28 are then positioned facing each other from the first side P towards the second side D. Each main electrode is connected to respectively one of the connection terminals (described subsequently in the description).

The exemplary protection device further includes the intermediate electrode 26 located in an intermediate position between the main electrodes 24 and 28. When the main electrodes form the spark-gap 20, the intermediate electrode partly extends between both main electrodes from the second side D. The device includes the normally open semiconductor switch and connecting the intermediate electrode 26 to the first main electrode 24.

The exemplary protection device further includes a circuit 78 for controlling the semiconductor switch. The assembly formed by the semiconductor switch and the control circuit 78 is referenced as 70 in FIG. 1. The control circuit 78 is provided in order to successively close and open the switch after dividing the electric arc 62 formed between the main electrodes 24 and 28 into two secondary arcs 64 and 68 by the intermediate electrode 26. The control circuit 78 may thus control the device so as to apply the steps of the method described earlier, following the formation of the arc 62 between the main electrodes 24 and 28. The exemplary detection device of the present disclosure may then have a compact design. For example, the protection device may be shaped as a "mountable" casing on a DIN rail with a length not exceeding 92 mm. FIG. 3 shows a sectional view of in accordance with an exemplary embodiment a device for protection against voltage surges. FIG. 3 shows a sectional view of such an embodiment of the exemplary protection device 90 for protection against voltage surges, the device 90 including an external casing 92 corresponding to a "mountable" casing on a DIN rail. The "mountable" casing 92 on a DIN rail includes an interface 96 for mounting on a DIN rail (not shown).

Generally, the exemplary protection device may be specially designed for applying one of the embodiments of the previous methods.

Thus, in the exemplary protection device of the present disclosure, the control circuit 78 may ensure the time-out before closing the switch and/or between the closing of the switch and the opening of the switch. Referring back to FIG. 2, in order to ensure these time-outs and the control of the semiconductor switch, the control circuit 78 may be powered by a portion 44 of the follow current 42 flowing through the intermediate electrode 62.

FIG. 4 shows an electric diagram of the circuit for controlling a semiconductor switch of the protection device of FIG. 3 in accordance with an exemplary embodiment. The assembly 70 is thus connected to the intermediate electrode 26 and to the main electrode 24. The semiconductor switch is in the form of an IGBT. $R_1$ represents the resistance of the conducting lines. The assembly 70 operates in the following way. When the voltage 52 of the arc 64 appears (at the beginning of phase 34), a capacitor $C_1$ is charged through a resistance $R_1$. Depending on the calibration of $C_1$ and $R_1$, the desired charging time is obtained for $C_1$ allowing the intended time-out of phase 34. When the charge of the capacitor $C_1$ enables the reverse voltage of a Zener diode $DZ_1$ to be reached, the Zener diode becomes conducting and establishes a voltage at the terminals of a resistor $R_2$. The voltage at the terminals of the resistor $R_2$ allows switching of the thyristor $T_1$ into the conducting state. The IGBT then sees a voltage at its gate causing the IGBT to pass to the conducting state, which limits the voltage of the arc 64 to a voltage $V_{CEsat}$ of the IGBT. As the IGBT is then conducting, the arc 64 disappears but a current still flows in the spark-gap via the IGBT. In other words, the portion 72 of the control circuit 78 ensures control upon closing the IGBT. Phase 36 is entered.

After the moment when the IGBT becomes conducting, the capacitor $C_1$ maintains the control voltage and charges a capacitor $C_2$ via a resistor $R_4$. Depending on the calibration of $C_2$ and $R_2$, the desired charging time for $C_2$ is obtained allowing the intended time-out of phase 36. When the capacitor $C_2$ voltage reaches the reverse voltage of a Zener diode $DZ_2$, the Zener diode $DZ_2$ becomes conducting. This causes a voltage to be applied to the terminals of a resistor $R_5$, allowing switching of the thyristor $T_2$ into the conducting state. The IGBT is then short-circuited and the IGBT passes from the conducting state to the blocked state. The follow current is cut off by the opening of the IGBT and the arc 68 is extinguished. In other words, the portion 74 of the control circuit 78 ensures control upon opening the IGBT. Phase 38 is entered.

Following the extinction of the arc 68, the capacitors $C_1$ and $C_2$ are respectively discharged into the resistors $R_3$ and $R_6$.

In an exemplary embodiment of the present disclosure varistor $V_1$ is provided for ensuring the protection of the IGBT while suppressing the possible lightning current peak associated with the voltage surge in the case when there is still a voltage surge at the moment when the arc 62 is separated into arcs 64 and 68. Generally, in all the embodiments described earlier, the positioning of the intermediate electrode 26 on the side D of the main electrode may be adjusted in order to ensure an intended time-out for the duration of phase 32. The time-out of the phase 32 may thus correspond to a sufficiently long duration so that the voltage surge episode, for example due to lightning impact, is finished before the beginning of phase 34.

Referring back to FIG. 4, diodes $D_1$, $D_2$ and $D_3$ are provided for protecting the circuit 78 by forcing the direction of the current. Thus the portion 76 of the control circuit 78 ensures protection of the IGBT.

According to another exemplary embodiment of the disclosure, the semiconductor switch may include a plurality of IGBTs positioned in parallel relatively to each other, for example two IGBTs in parallel. Such a parallel arrangement of IGBTs, allows the thereby formed semiconductor switch to drain a larger follow current intensity as compared with the semiconductor switch including a single IGBT. Such an embodiment is particularly advantageous for uses of the exemplary protection device disclosed herein relating to the protection of photovoltaic installations which may provide high intensity currents, such as an intensity of more than 1,000 A. According to this exemplary embodiment, the control circuit 78 illustrated in FIG. 4 may be used by itself for controlling in parallel the plurality of IGBTs.

In the exemplary circuit illustrated in FIG. 4, a resistor $R_P$ for limiting the current intensity may be positioned in series with the diode $D_1$. $R_P$ has a sufficiently large resistance for limiting the intensity of the current flowing through the control circuit 78 to a level below the threshold intensity of the current for maintaining the arc 68. In other words, the limitation resistor $R_P$ prevents flowing of the follow current of the arc 68 as far as the electrode 24 via the control circuit 78. Thus, the limitation resistor $R_P$ contributes to extension of the arc 68, at the moment of the transition between phases 36 and 38, e.g., at the moment when the IGBT is opened which drains the follow current 42 of the arc 68, the arc 64 having been extinguished by closing the IGBT beforehand.

Depending on the exemplary embodiment selected for the control circuit 78, any other means for limiting the intensity of the current flowing through the control circuit 78 may be provided for limiting such an intensity to a level below the threshold intensity of the current for maintaining the arc 68 in the exemplary protection device. According to an exemplary embodiment, the selection of the means for limiting the intensity results from a compromise between the limitations of the intensity of the control circuit and obtaining a level for this intensity which is sufficient for operating the control circuit of the semiconductor switch.

According to another exemplary embodiment, the device may include a magnet positioned for displacing the electric arc 62 from the first side P to the second side D. The magnet may correspond to an assembly of opposite poles of distinct permanent magnets. FIG. 5 shows a schematic illustration of a detection device having a magnet in accordance with an exemplary embodiment. The magnet 80 is formed by the assembly of two opposite poles of distinct permanent magnets 82 and 84. The distance between the magnets 82 and 84 may be maintained by any suitable member such as air gaps 86. The magnet 80 is positioned so as to generate magnetic field lines 88 through the spark-gap 20 which are perpendicular both to the extension direction of the arc 62 and to the direction of the desired movement of the arc 62. The orientation of the magnet 80 conditions the displacement of the arc 62 from side P to side D.

In an exemplary protection device having no magnet, the electric arc formed in the device moves under the effect of its own energy. The higher the intensity of the current drained by the arc, the more the displacement of the arc is facilitated. When the intensity of the current drained by the arc is too low, the arc 62 may have difficulties in moving under the sole effect of its own energy. For certain electric installations notably for installations for photovoltaic generation of electricity, the follow currents may assume very low values. Indeed, the follow current of an installation for photovoltaic generation of electricity may have several values between a quasi zero value (night time) and a maximum value (daytime without any clouds). These low follow current values such as currents of the order of 0.5 A, may not be sufficient for operating cut-off systems exclusively based on the displacement of the arc under its own energy. The use of the magnet in the device 90 then gives the possibility of facilitating the displacement of the arc 62 even in the case of a low follow current intensity. Such an embodiment of the device 90 gives the possibility of obtaining a device for protecting an electric installation against voltage surges, independently of the value of the follow current. In another exemplary embodiment of the present disclosure, the main electrodes 24 and 28 of the device may be divergent from the first side P to the second side D, as illustrated in FIGS. 1 and 3. The divergence of the main electrodes contributes, like the magnet, to the displacement of the electric arc 62 from P to D.

In yet another exemplary embodiment, the intermediate electrode 26 may have a wedge-shaped end portion on the side where the intermediate electrode 26 extends between both electrodes 24 and 28. The wedge-shaped end of the intermediate electrode is then the end of the electrode which is the closest to the side D of the main electrode 24 and 28. According to FIG. 3, such a wedge-shaped end portion 66 may have a triangular shape. The wedge-shaped end of the intermediate electrode 26 gives the possibility of having surfaces of the electrode 26 which are parallel to the electrodes 24 and 28, when the electrodes 24 and 28 are divergent. Making such parallel surfaces contributes to facilitating the displacement of the arc 62 from side P to side D at the moment when the arc 62 separates into both arcs 64 and 68. Actually, when phase 34 is entered, these parallel surfaces limit the increase in the voltage at the terminals of the main electrodes 24 and 28 because of the non-increase in the distance to be covered by the arcs between the electrodes 24 and 28.

FIGS. 6 and 7 show exploded views of a detection device in a cartridge which is "mountable" on a DIN rail in accordance with an exemplary embodiment. FIGS. 6 and 7 show exploded views of an exemplary embodiment of the detection device of the present disclosure in the "mountable" cartridge 92 on a DIN rail. FIG. 6 shows an exploded view on the right side of the device 20 while FIG. 7 shows an exploded view on the left side of the device 20. FIG. 6 allows viewing of the spark-gap 20 formed by the electrodes 24, 26 and 28. The cartridge or the casing 92 is formed with four portions. Two middle portions of the cartridge 92 allow formation of a cover around the spark-gap 20. The two other portions of the cartridge 92 are the two end portions of the cartridge 92. These end portions ensure the formation of a cover around the magnets 82 and 84. According to this embodiment illustrated in FIG. 7, the end portion of the cartridge 92 which forms the cover of the magnet 82 houses the assembly 70 formed by the IGBT and the control circuit 78.

FIG. 8 shows a schematic illustration of a protection device with an additional connection terminal in accordance with an exemplary embodiment. As shown in FIG. 8, connection terminals 98 and 94 of the device 90 for the electric installation to be protected are provided such that electrode 24 is connected to the terminal 94 while the electrode 28 is connected to the terminal 98.

FIG. 8 also shows a schematic illustration of an exemplary embodiment of the protection device and which forms an enhancement of the embodiment illustrated by FIGS. 6 and 7. According to FIG. 8, the device 90 includes an additional terminal 198 in addition to both connection terminals 98 and 94. The device 90 includes an additional spark-gap 120 to the spark-gap 20 described earlier. This spark-gap 120 includes two additional electrodes 124 and 128. The electrode 128 is connected to the additional terminal 198 while the electrode 124 is connected to the electrode 24. According to this exemplary embodiment, this additional spark-gap 120 may be without any intermediate electrode. The electrodes 124 and 128 of the additional spark-gap 120, may also diverge between a first side P and a second side D. The device 90 with the additional terminal 198 may be connected to three distinct conductors of the electric installation to be protected. Thus, the device 90 may ensure a Y protection mode between two active conductors of the electric installation to be protected and a ground conductor.

When the electric installation to be protected is an installation operating with DC current, the two active conductors are the conductor with polarity + and the conductor with polarity − respectively. It is estimated that in 60% of the installations of this type, the polarities + and − are floating relatively to the ground. For the remaining installations where one of the active conductors is connected to the ground, it is estimated that it is the conductor with polarity + which is connected to the ground in 95% of the cases. Thus, upon using the device 90 in the Y protection mode, the terminals 98 and 198 can be connected to the conductors with polarity − and + respectively, while the terminal 94 may be connected to the ground. According to this connection diagram, for the large majority of installations operating with DC current, the spark-gap 20 with the intermediate electrode 26 is connected between the ground and an active connector not connected to the ground. This allows the device 90 to ensure efficient Y protection with a follow current which is cut off for the large majority of installations operating with DC current.

In the case of a single-phase electric installation operating with AC current, one of the two protected active conductors may be the phase while the other one of the two protected active conductors may be the neutral.

In a symmetrical embodiment of device 90 as illustrated in FIG. 8, another terminal 194 may be provided at the connection of the electrode 124 to the electrode 24. However, this terminal 194 is at the same potential as the terminal 94.

Still with reference to FIG. 8, the embodiment of the device 90 with the additional terminal 198 may be housed in a "mountable" casing 92 on a DIN rail having a width L of less than or equal to three times the standard 17.5 mm width of "mountable" casings on a DIN rail. In an exemplary embodiment of the device without any additional terminal, the device 90 may include a "mountable" casing 92 on a DIN rail having a width of less than or equal to twice the standard 17.5 mm width of "mountable" casings on a DIN rail.

The device 90 in the different embodiments described earlier may include a unit for triggering an arc between the main electrodes 24 and 28, or 124 and 128 if need be. FIG. 8 illustrates such a triggering unit 22. The triggering unit 22 may include an electrode for triggering the arc on side P of the spark-gap 20, on the side P of the spark-gap 120. Thus, the triggering electrode is positioned on the side of the main electrodes where the formation of an electric arc is easiest when a voltage surge occurs. Consequently, such an electrode for triggering an electric arc is different from the intermediate electrode described earlier.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for cutting off an electric arc being formed between two main electrodes, the method comprising:

displacing the formed electric arc towards an electrode located in an intermediate position between both main electrodes;

separating the electric arc formed into two secondary electric arcs between the main electrodes and the intermediate electrode, a semiconductor switch, normally open, connecting the intermediate electrode to one of the main electrodes;

closing the semiconductor switch for extinguishing the secondary electric arc between both electrodes which are connected by the semiconductor switch; and opening the semiconductor switch in order to extinguish the other secondary electric arc.

2. The cut-off method according to claim 1, comprising a time-out after the separation of the formed arc into two second electric arcs for preventing an arc from re-forming between both main electrodes upon closing the semiconductor switch.

3. The cut-off method according to claim 1, comprising a time-out, after closing the semiconductor switch for preventing, upon opening the semiconductor switch, the extinguished arc from reforming between the intermediate electrode and one of the main electrodes.

4. A method for protecting an electric installation against transient voltage surges, the method applying the cutting-off of an electric arc according to the method of claim 1, wherein when a transient voltage surge occurs in the electric installation to be protected causing the formation of a first electric arc between both main electrodes, the main electrodes being connected to the electric installation to be protected.

5. The method for protecting an electric installation according to claim 4, the electric installation to be protected being an electric installation connected to a low voltage electricity distribution network.

6. The method for protecting an electric installation according to claim 5, the electric installation to be protected being an electric installation operating with DC current.

7. A device for protecting an electric installation against transient voltage surges, comprising:

two terminals for connecting the device to the electric installation to be protected;

a first main electrode and a second main electrode, each main electrode being connected to respectively one of the connection terminals;

an electrode located in an intermediate position between the first main electrode and the second main electrode;

a semiconductor switch, normally open, connecting the intermediate electrode to the first main electrode; and a circuit for controlling the semiconductor switch, the control circuit being provided in order to successively ensure closing of the switch, and then opening of the switch, after division of an electric arc formed between the main electrodes into two arcs by the intermediate electrode.

8. The device according to claim 7, wherein the semiconductor switch is an insulated gate bipolar transistor or a metal oxide gate field effect transistor.

9. The device according to claim 7, wherein the control circuit ensures a timeout between the division of the electric arc into two arcs by the intermediate electrode and the closing of the switch and/or between the closing of the switch and the opening of the switch.

10. The device according to claim 7, wherein the electrodes are fixed, both main electrodes being positioned facing each other from a first side to a second side, and forming a spark-gap; and the intermediate electrode partly extending between both main electrodes from the second side.

11. The device according to claim 10, comprising a unit for triggering an arc between the main electrodes in the case when a transient voltage surge occurs on the electric installation to be protected, the triggering unit including an arc-triggering electrode on the first side of the main electrodes.

12. The device according to claim 10, wherein the intermediate electrode has a wedge-shaped end portion on the side where the intermediate electrode extends between both main electrodes.

13. The device according to claim 10, comprising a magnet positioned in order to displace, in a direction from the first side to the second side, an electric arc being formed between the main electrode of the spark-gap and/or the main electrodes being divergences from the first side to the second side.

14. The device according to claim 10, comprising an additional connection terminal and an additional spark-gap formed with two additional electrodes, one of the additional electrodes being connected to the additional terminal and the other one of the additional electrodes being connected to one of the two terminals for connecting the device to the electric installation.

15. A device for performing a method for protecting an electric installation against transient voltage surges according to claim 4, the device comprising:

two terminals for connecting the device to the electric installation to be protected;

a first main electrode and a second main electrode, each main electrode being connected to respectively one of the connection terminals;

an electrode located in an intermediate position between the first main electrode and the second main electrode;

a semiconductor switch, normally open, connecting the intermediate electrode to the first main electrode; and a circuit for controlling the semiconductor switch, the control circuit being provided in order to successively ensure closing of the switch, and then opening of the switch, after division of an electric arc formed between the main electrodes into two arcs by the intermediate electrode.

* * * * *